US006929414B2

(12) United States Patent
Kadomatsu

(10) Patent No.: US 6,929,414 B2
(45) Date of Patent: Aug. 16, 2005

(54) READING/RECORDING APPARATUS, READING CONTROL METHOD, AND PROGRAM FOR IMPLEMENTING THE METHOD

(75) Inventor: Daiki Kadomatsu, Ibaraki (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 10/760,134

(22) Filed: Jan. 16, 2004

(65) Prior Publication Data

US 2004/0218946 A1 Nov. 4, 2004

(30) Foreign Application Priority Data

Jan. 17, 2003 (JP) ..... 2003-010035

(51) Int. Cl.[7] ..... B41J 3/44

(52) U.S. Cl. ..... 400/608.2; 400/605; 400/607; 400/624; 400/629; 271/9.05; 271/9.11; 271/9.13; 358/296

(58) Field of Search ..... 400/605, 607, 400/608.2, 624, 629; 271/9.05, 9.13, 9.11; 358/296

(56) References Cited

U.S. PATENT DOCUMENTS 5,651,623 A * 7/1997 Stodder et al. ..... 400/605
5,954,326 A * 9/1999 Gaarder et al. ..... 271/9.02
6,029,970 A * 2/2000 Hwang ..... 271/9.08
6,520,700 B1 * 2/2003 Iwata ..... 400/582

FOREIGN PATENT DOCUMENTS

JP 60016763 A * 1/1985 ..... H04N/1/04
JP 01093866 A * 4/1989 ..... G06F/15/64
JP 09193478 A * 7/1997 ..... B41J/3/44
JP 2000299767 A * 10/2000 ..... H04N/1/04

* cited by examiner

*Primary Examiner*—Daniel J. Colilla
(74) *Attorney, Agent, or Firm*—Ross, Kimms & McDowell LLP

(57) ABSTRACT

There is provided a reading/recording apparatus which is capable of properly conveying originals during original reading operation, even if there exists a state where a recording medium conveying device shares the same space with an original conveying path. A shared conveying path has at least part thereof used as both a conveying path for an original and a conveying path for a recording medium. The original is conveyed on the shared conveying path, where an image of the original is read. The read image is recorded on the recording medium at a recording position on the shared conveying path. A recording medium conveying device is movable between a sharing state where the recording medium conveying device shares a space with the conveying path for the original and a non-sharing state where the recording medium conveying device does not share the space with the conveying path for the original, and conveys the recording medium on the shared conveying path. Conveyance of the original is stopped when the recording medium conveying device is detected to be in the sharing state during an original reading operation.

32 Claims, 10 Drawing Sheets

READING/RECORDING APPARATUS, READING CONTROL METHOD, AND PROGRAM FOR IMPLEMENTING THE METHOD

BACKGROUND OF THE INVENTION

1. Field of the Invention

The present invention relates to a reading/recording apparatus, a reading control method, and a program for implementing the method.

2. Description of the Related Art

In recent years, as terminal apparatuses have been made smaller in size, there have also been demands for miniaturization of information terminal apparatuses. In particular, in a reading/recording apparatus such as a facsimile apparatus for domestic use, a sheet conveying mechanism used for a reading operation and a sheet conveying mechanism used for a recording operation are completely separate from each other, so that a space where a reading unit reads an original (document) during transmission is separate from a space where a recording unit performs the recording operation during reception.

FIG. 11 is a cross-sectional view showing the construction of a conventional reading/recording apparatus. In this conventional reading/recording apparatus, recording sheets 301 are placed on a recording sheet holding member 303 and are fed sheet by sheet by a recording sheet feeding roller 304 and a separating mechanism. The fed recording sheet is conveyed to a recording section 306 by a conveying roller 305 and is discharged from the apparatus (in the direction shown by the arrow B in FIG. 11) by a discharge roller 307 while an image is being formed on the recording sheet by a recording section such as an inkjet cartridge.

On the other hand, originals 302 are placed on an original holding member 308 and are set on a wedge-shaped abutting section formed of an original separating roller 309 and a separating arm 313. When the original separating roller 309 rotates according to an image reading instruction, out of the originals held at the abutting section, only an original in contact with the original separating roller 309 is separated using friction and is conveyed.

The separated and conveyed original 302 is further conveyed by an original feeding roller 310, a discharge roller 312, and opposing rollers while being held therebetween. While an image on the original 302 is being read by a contact image sensor 311, the original 302 is discharged from the apparatus (in the direction shown by the arrow A in FIG. 11).

For a reading/recording apparatus such as a copier or a facsimile apparatus, various functions and improvements are implemented to make such apparatus more convenient to use, according to demands from customers. One of such demands is for miniaturization of the apparatus. For users who wish to make effective use of limited space, apparatus size is especially important when purchasing equipment.

However, in the conventional reading/recording apparatus described above, the sheet conveying mechanism for the reading operation and the sheet conveying mechanism for the recording operation are completely separate from each other, that is, the space in which the reading unit reads the original during transmission is separate from the space in which the recording unit performs the recording operation during reception, so that it is necessary to provide separate physical spaces for the reading operation and the recording operation. This makes it difficult to miniaturize the apparatus.

On the other hand, there is known a technique for reducing the apparatus size by using a single reading/recording path mechanism in which a recording sheet stacking member and an original stacking member are disposed close to each other with a shared conveying path on which both originals and recording sheets are conveyed. By thus using the same conveying mechanism for conveying recording sheets and for conveying originals, it is possible to omit a feed roller, discharge roller, original driving motor, original detecting sensor, and the like that are used for conveying originals.

However, with the arrangement according to this known technique, a recording sheet conveying roller for conveying recording sheets is disposed above the original stacking member so that the recording sheet conveying roller shares the same space with the recording conveying path. Therefore, when the recording sheet conveying roller is in a position where it protrudes toward the original stacking member, an original placed on the original stacking member cannot be smoothly conveyed from the original stacking member during original reading operation.

SUMMARY OF THE INVENTION

It is an object of the present invention to provide a reading/recording apparatus and a reading control method which are capable of properly conveying originals during original reading operation, even if there exists a state where a recording medium conveying device shares the same space with an original conveying path (a state where the recording medium conveying device blocks the original conveying path when it conveys a recording medium), as well as a program for implementing the reading/recording control method.

To attain the above object, in a first aspect of the present invention, there is provided a reading/recording apparatus comprising a shared conveying path having at least part thereof used as both a conveying path for an original and a conveying path for a recording medium, an original conveying device that conveys the original on the shared conveying path, a reading device that reads an image of the original at a reading position on the shared conveying path, a recording device that records the read image on the recording medium at a recording position on the shared conveying path, a recording medium conveying device that is movable between a sharing state where the recording medium conveying device shares a space with the conveying path for the original and a non-sharing state where the recording medium conveying device does not share the space with the conveying path for the original, and conveys the recording medium on the shared conveying path, a state detecting device that detects a state of the recording medium conveying device, and a control device that stops conveyance of the original by the original conveying device when the recording medium conveying device is detected to be in the sharing state by the state detecting device during a reading operation on the original by the reading device.

According to the first aspect of the present invention, it is possible to properly convey originals during an original reading operation, even if there exists a state where the recording medium conveying device shares the same space with the original conveying path. Further, if the recording medium conveying device is in the sharing state during a reading operation, conveyance of the original is stopped, whereby damage to originals can be prevented.

Preferably, the non-sharing state is an initial state where the recording medium conveying device is on standby when the recording device does not carry out a recording operation on the recording medium.

More preferably, the reading/recording apparatus comprises a notification device operable when the recording medium conveying device is detected to be in the sharing state by the state detecting device, to notify that the recording medium conveying device is not in the initial state.

Also preferably, the reading/recording apparatus comprises a notification device operable when the recording medium conveying device is detected to be in the sharing state by the state detecting device, to notify that the original conveying device does not carry out an operation of conveying the original.

With the above arrangement, the user is notified that the original conveying device does not carry out the operation of conveying the original, whereby the user can know that the reading/recording apparatus is in an abnormal state and cannot perform the reading operation.

Also preferably, the reading/recording apparatus comprised a leading edge detecting device operable when the recording medium conveying device is detected to be in the non-sharing state, to detect a leading edge of the original passing on the shared conveying path, and wherein when the leading edge of the original has not been detected, the state detecting device detects the state of the recording medium conveying device again.

More preferably, the reading/recording apparatus further comprises a reading control device operable when the leading edge of the original has not been detected, to temporarily stop the reading operation by the reading device.

Also preferably, the recording medium conveying device has a non-circular roller, and the recording medium conveying device is movable between the sharing state and the non-sharing state through rotation of the non-circular roller.

Also preferably, the reading/recording apparatus comprises a storage device that stores image information based on the image of the original read by the reading device.

Also preferably, the reading device is movable between the reading position and a reading standby position apart from the reading position, and the recording device shares a moving space on the shared conveying path with the reading device, the recording device being movable between the recording position and the recording standby position apart from the recording position.

To attain the above object, in a second aspect of the present invention, there is provided a reading/recording apparatus comprising a shared conveying path having at least part thereof used as both a conveying path for an original and a conveying path for a recording medium, an original conveying device that conveys the original on the shared conveying path, a reading device that reads an image of the original at a reading position on the shared conveying path, a recording device that records the read image on the recording medium at a recording position on the shared conveying path, a recording medium conveying device that is movable between a sharing state where the recording medium conveying device shares a space with the conveying path for the original and a non-sharing state where the recording medium conveying device does not share the space with the conveying path for the original, and conveys the recording medium on the shared conveying path, a state detecting device that detects a state of the recording medium conveying device, and a control device that inhibits conveyance of the original by the original conveying device when the recording medium conveying device is detected to be in the sharing state by the state detecting device before the start of a reading operation on the original by the reading device.

According to the second aspect of the present invention, if the reading medium conveying device is in the sharing state before the start of a reading operation, the original conveying operation is inhibited, whereby damage to originals can be prevented.

Preferably, the non-sharing state is an initial state where the recording medium conveying device is on standby when the recording device does not carry out a recording operation on the recording medium.

More preferably, the reading/recording apparatus comprises a notification device operable when the recording medium conveying device is detected to be in the sharing state by the state detecting device, to notify that the recording medium conveying device is not in the initial state.

Also preferably, the reading/recording apparatus comprises a notification device operable when the recording medium conveying device is detected to be in the sharing state by the state detecting device, to notify that the original conveying device does not carry out an operation of conveying the original.

With the above arrangement, the user is notified that the original conveying device does not carry out the operation of conveying the original, whereby the user can know that the reading/recording apparatus is in an abnormal state and cannot perform the reading operation.

Also preferably, the reading/recording apparatus comprises a reading control device that permits the reading operation to be started when the recording medium conveying device is detected to be in the non-sharing state.

Also preferably, the reading/recording apparatus comprises a conveying medium detecting device operable when the recording medium conveying device is detected to be in the sharing state, to detect whether a conveying medium exists on the shared conveying path, and a forcible discharge device operable when the conveying medium is detected to exist on the shared conveying path, to forcibly discharges the conveying medium.

More preferably, the reading/recording apparatus comprises a reading control device that permits the reading operation to be started when the recording medium conveying device is detected to be in the non-sharing state after the conveying medium has been forcibly discharged by the forcible discharge device.

Also preferably, the recording medium conveying device has a non-circular roller, and the recording medium conveying device is movable between the sharing state and the non-sharing state through rotation of the non-circular roller.

Also preferably, the reading/recording apparatus comprises a storage device that stores image information based on the image of the original read by the reading device.

Also preferably, the reading device is movable between the reading position and a reading standby position apart from the reading position, and the recording device shares a moving space on the shared conveying path with the reading device, the recording device being movable between the recording position and the recording standby position apart from the recording position.

To attain the above object, in a third aspect of the present invention, there is provided a reading/recording apparatus comprising a shared conveying path having at least part thereof used as both a conveying path for an original and a conveying path for a recording medium, an original conveying device that conveys the original on the shared conveying path, a reading device that reads an image of the original at a reading position on the shared conveying path, a recording device that records the read image on the recording medium at a recording position on the shared conveying path, a recording medium conveying device that is movable between a sharing state where the recording medium conveying device shares a space with the conveying path for the original and a non-sharing state where the recording medium conveying device does not share the space with the conveying path for the original, and conveys the recording medium on the shared conveying path, a state detecting device that detects a state of the recording medium conveying device, and a control device that causes the recording medium conveying device to move into the non-sharing state when the recording medium conveying device is detected to be in the sharing state by the state detecting device at a start of a reading operation on the original by the reading device.

According to the third aspect of the present invention, the reading medium conveying device is caused to move into the non-sharing state, even if the reading medium conveying device is in the sharing state when an instruction for starting the recording operation has been given by the user, whereby it is possible to properly convey originals.

Preferably, the non-sharing state is an initial state where the recording medium conveying device is on standby when the recording device does not carry out a recording operation on the recording medium.

More preferably, the reading/recording apparatus comprises a notification device operable when the recording medium conveying device is detected to be in the sharing state by the state detecting device, to notify that the recording medium conveying device is not in the initial state.

Also preferably, the reading/recording apparatus comprises a notification device operable when the recording medium conveying device is detected to be in the sharing state by the state detecting device, to notify that the original conveying device does not carry out an operation of conveying the original.

With the above arrangement, the user is notified that the original conveying device does not carry out the operation of conveying the original, whereby the user can know that the reading/recording apparatus is in an abnormal state and cannot perform the reading operation.

Also preferably, the recording medium conveying device has a non-circular roller, and the recording medium conveying device is movable between the sharing state and the non-sharing state through rotation of the non-circular roller.

Also preferably, the reading/recording apparatus comprises a storage device that stores image information based on the image of the original read by the reading device.

Also preferably, the reading device is movable between the reading position and a reading standby position apart from the reading position, and the recording device shares a moving space on the shared conveying path with the reading device, the recording device being movable between the recording position and the recording standby position apart from the recording position.

To attain the above object, in a fourth aspect of the present invention, there is provided a reading control method of performing a reading operation of reading an image on an original and a recording operation of recording the read image onto a recording medium on a shared conveying path having at least part thereof used as both a conveying path for the original and a conveying path for the recording medium, comprising an original conveying step of conveying the original on the shared conveying path, a reading step of reading an image of the original at a reading position on the shared conveying path, a recording step of recording an image on the recording medium at the recording position, a recording medium conveying step of causing a recording medium conveying device to convey the recording medium on the shared conveying path, the recording medium conveying device being movable between a sharing state where the recording medium conveying device shares a space with the conveying path for the original and a non-sharing state where the recording medium conveying device does not share the space with the conveying path for the original, a state detecting step of detecting a state of the recording medium conveying device, and a control step of stopping conveyance of the original in the original conveying step when the recording medium conveying device is detected to be in the sharing state in the state detecting step during a reading operation on the original in the reading step.

To attain the above object, in a fifth aspect of the present invention, there is provided a reading control method of performing a reading operation of reading an image on an original and a recording operation of recording the read image onto a recording medium on a shared conveying path having at least part thereof used as both a conveying path for the original and a conveying path for the recording medium, comprising an original conveying step of conveying the original on the shared conveying path, a reading step of reading an image of the original at a reading position on the shared conveying path, a recording step of recording an image on the recording medium at the recording position, a recording medium conveying step of causing a recording medium conveying device to convey the recording medium on the shared conveying path, the recording medium conveying device being movable between a sharing state where the recording medium conveying device shares a space with the conveying path for the original and a non-sharing state where the recording medium conveying device does not share the space with the conveying path for the original, a state detecting step of detecting a state of the recording medium conveying device, and a control step of inhibiting conveyance of the original in the original conveying step when the recording medium conveying device is detected to be in the sharing state in the state detecting step before a start of a reading operation on the original in the reading step.

To attain the above object, in a sixth aspect of the present invention, there is provided a reading control method of performing a reading operation of reading an image on an original and a recording operation of recording the read image onto a recording medium on a shared conveying path having at least part thereof used as both a conveying path for the original and a conveying path for the recording medium, comprising an original conveying step of conveying the original on the shared conveying path, a reading step of reading an image of the original at a reading position on the shared conveying path, a recording step of recording an image on the recording medium at the recording position, a recording medium conveying step of causing a recording medium conveying device to convey the recording medium on the shared conveying path, the recording medium conveying device being movable between a sharing state where the recording medium conveying device shares a space with the conveying path for the original and a non-sharing state where the recording medium conveying device does not share the space with the conveying path for the original, a state detecting step of detecting a state of the recording medium conveying device, and a control step of causing the recording medium conveying device to move into the non-sharing state when the recording medium conveying device is detected to be in the sharing state in the state detecting step at a start of a reading operation on the original in the reading step.

To attain the above object, in a seventh aspect of the present invention, there is provided a program for causing a computer to execute a reading control method according to the fourth aspect of the present invention.

To attain the above object, in a eighth aspect of the present invention, there is provided a program for causing a computer to execute a reading control method according to the fifth aspect of the present invention.

To attain the above object, in a ninth aspect of the present invention, there is provided a program for causing a computer to execute a reading control method according to the sixth aspect of the present invention.

The above and other objects of the present invention will become more apparent from the following detailed description taken in conjunction with the accompanying drawings.

DETAILED DESCRIPTION OF THE PREFERRED EMBODIMENTS

The present invention will now be described in detail with reference to the accompanying drawings showing a preferred embodiment thereof.

Figure 1:
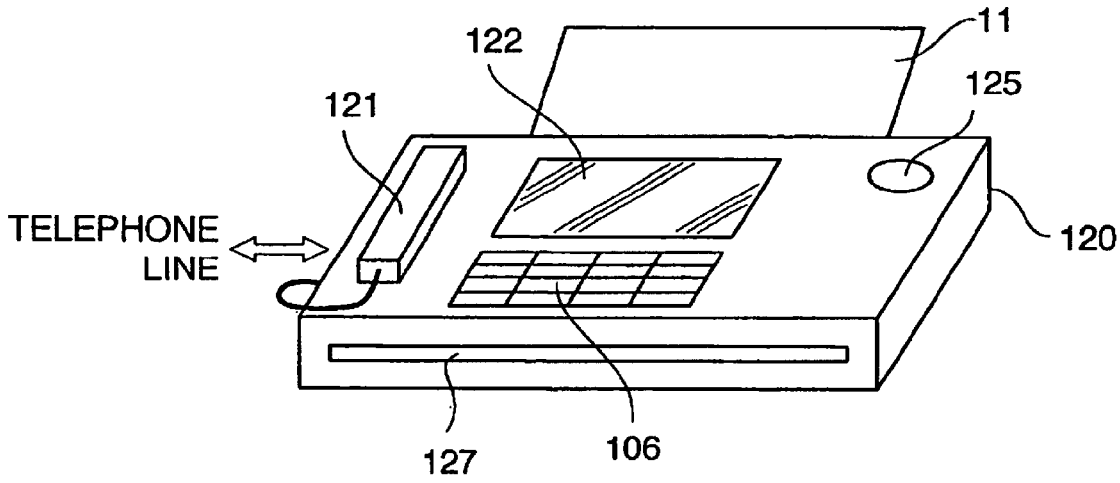
FIG. 1 is a perspective view showing the external appearance of a multifunction communication apparatus as a reading/recording apparatus according to an embodiment of the present invention.

FIG. 1 is a perspective view showing the external appearance of a reading/recording apparatus according to the embodiment. The reading/recording apparatus according to the present embodiment is applied to a multifunction communication apparatus that has a facsimile communication function and a copying function. This multifunction communication apparatus has a casing 120 with a discharge opening 127 provided in a front side thereof and an original tray 11 provided on a rear side thereof. A handset 121, a display 122, an operating section 106, an original discharge button (discharge key) 125, and so forth are provided on an upper surface of the casing 120.

The display 122 displays the state of the multifunction communication apparatus, a telephone number, and so forth. The operating section 106 is comprised of a plurality of keys and is used to input a telephone number or various kinds of setting information and to give instructions for operations. The original discharge button 125 is pressed to discharge an original or a recording sheet.

Figure 2:
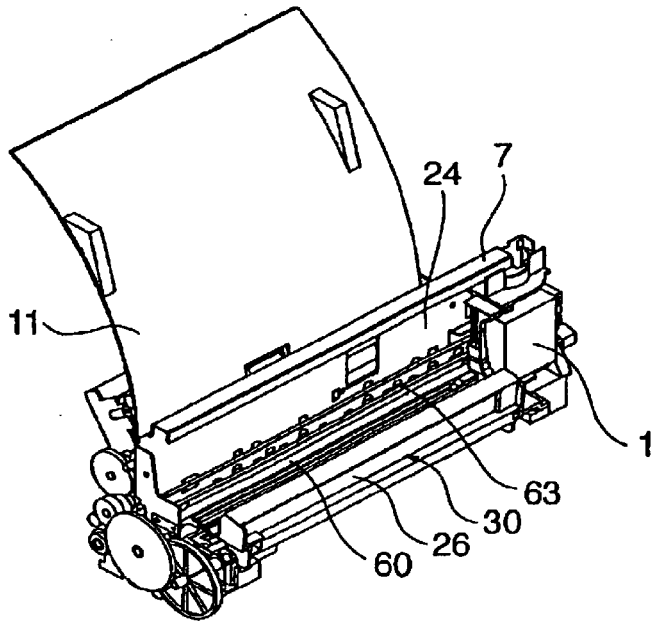
FIG. 2 is a perspective view showing the internal construction of the multifunction communication apparatus of FIG. 1.
Figure 3:
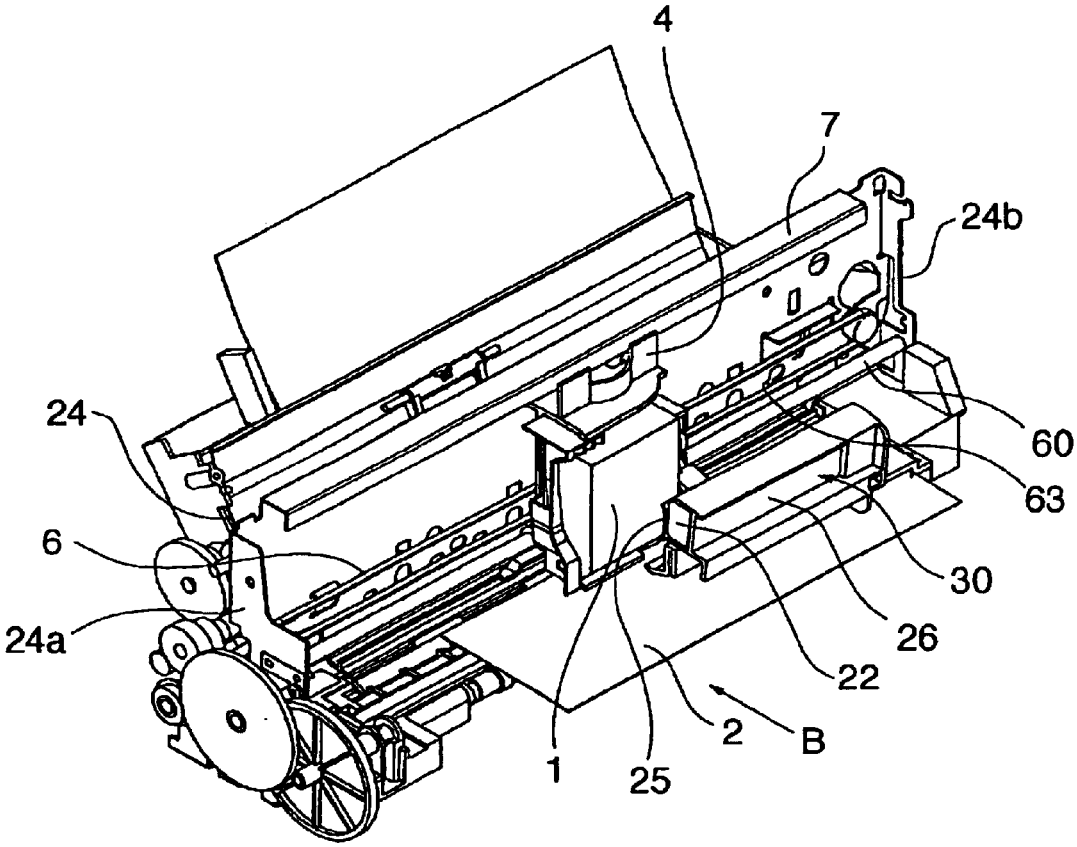
FIG. 3 is a perspective view showing the internal construction of the multifunction communication apparatus of FIG. 1 in a state where a recording unit is operating.
Figure 4:
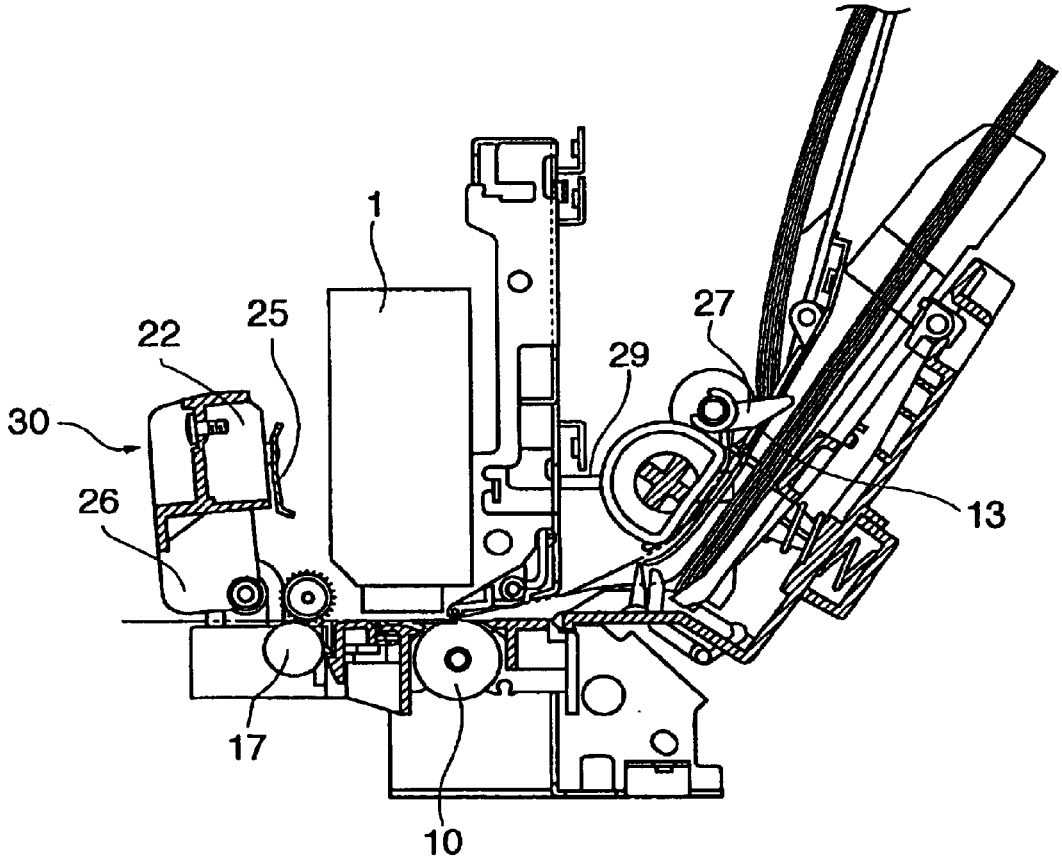
FIG. 4 is a cross-sectional side view showing the internal construction of the multifunction communication apparatus of FIG. 1 in the state where the recording unit is operating.
Figure 5:
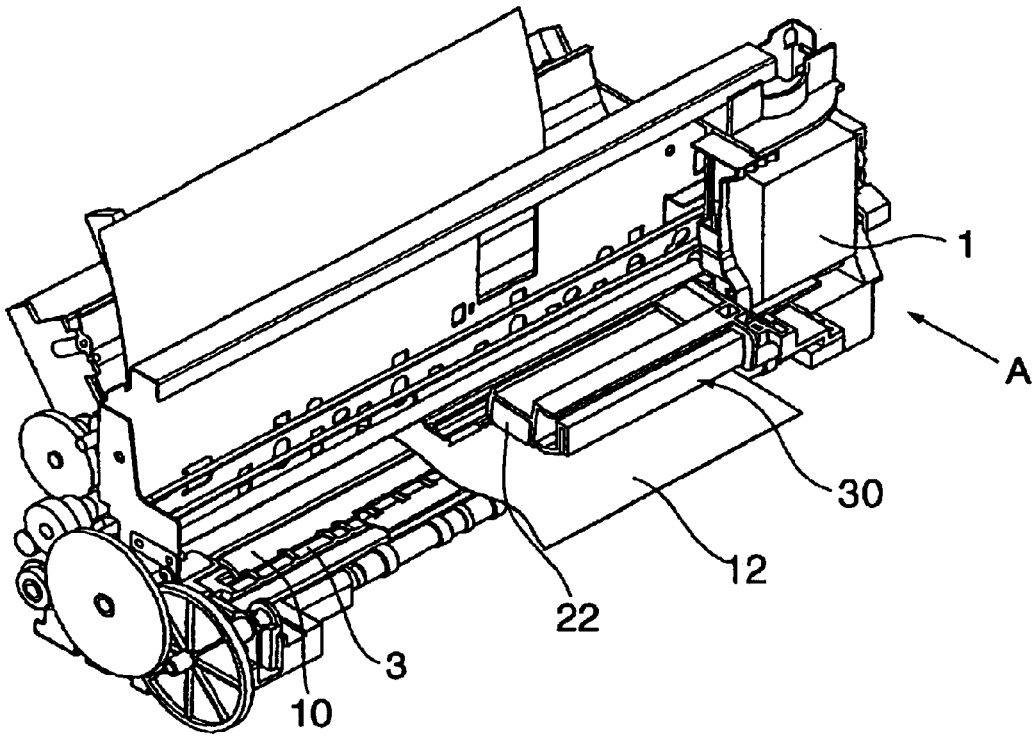
FIG. 5 is a perspective view showing the internal construction of the multifunction communication apparatus of FIG. 1 in a state where a reading unit is operating.
Figure 6:
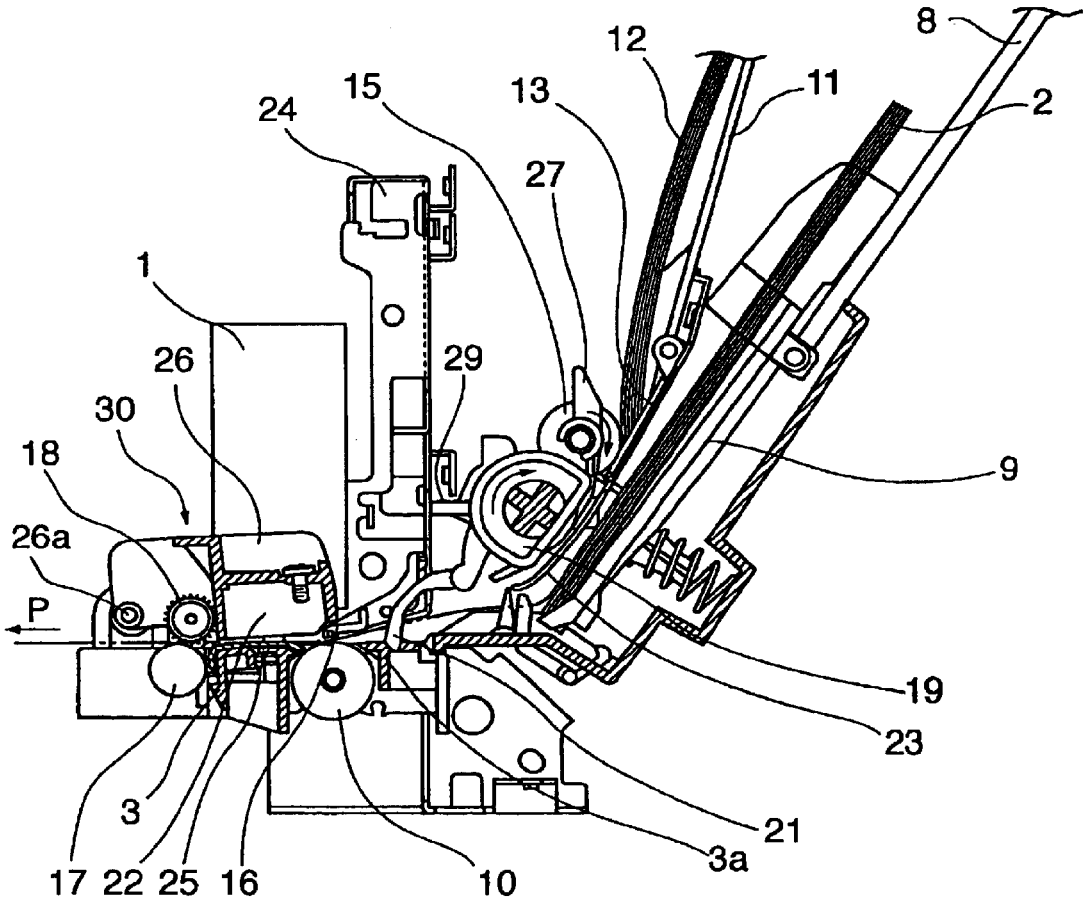
FIG. 6 is a cross-sectional side view showing the internal construction of the multifunction communication apparatus of FIG. 1 in the state where the reading unit is operating.

FIG. 2 is a perspective view showing the internal construction of the multifunction communication apparatus of FIG. 1. FIG. 2 shows a state where neither a recording sheet nor an original has been set and neither a reading unit nor a recording unit is operating, so that both the units are located in receded positions. FIG. 3 is a perspective view showing the internal construction of the multifunction communication apparatus of FIG. 1 in a state where the recording unit is operating. FIG. 4 is a cross-sectional side view showing the internal construction of the multifunction communication apparatus of FIG. 1 in a state where the recording unit is operating. FIG. 5 is a perspective view showing the internal construction of the multifunction communication apparatus of FIG. 1 in a state where the reading unit is operating. FIG. 6 is a cross-sectional side view showing the internal construction of the multifunction communication apparatus of FIG. 1 in a state where the reading unit is operating.

In FIGS. 2 to 6, reference numeral 1 designates an ink cartridge (the recording unit) that carries out, 3 a platen that is disposed in opposition to a surface of an original during a reading operation and to a surface of a recording sheet during a recording operation; 3*a* a platen supporting member that supports the platen 3; 8 a recording sheet tray on which recording sheets 2 are placed; 9 a pressing plate that presses the recording sheets 2 onto a recording sheet separating roller 19 when a recording sheet is to be separated; 10 a feed roller that feeds a conveyed medium (an original or a recording sheet) when reading or recording is carried out; 11 an original tray that holds originals, 13 a separating arm that separates an original 12; 15 an original separating/conveying roller that applies a force required to separate an original and conveys the original to the feed roller 10; 16 a pinch roller that supplements a driving force of the feed roller 10 during the feeding of the conveyed medium; 17 a discharge roller that discharges the conveyed medium out of the apparatus during reading and recording; 18 a spur that supplements a driving force of the discharge roller 17 when the conveyed medium is discharged; 19 a recording sheet separating/conveying roller that applies a force required to separate a recording sheet and conveys the recording sheet to the feed roller 10; and 21 a conveyed medium detecting sensor (paper edge sensor or "PES") that detects the presence of a conveyed medium during reading and during recording.

Further, reference numeral 22 designates a contact image sensor (CS) that carries out a reading operation; 23 an original lower guide member that guides an original 12; 24 a chassis; 25 a white reference determining member that determines a white reference level of an image read by the contact image sensor (CS) 22 during an operation that reads an original; and 26 a contact image sensor holder (CS holder) that supports the CS 22 and the white reference determining member 25, and is also supported for free rotation with respect to the apparatus main body about a rotary shaft 26*a* extending in a main scanning direction. A reading unit 30 is comprised of the CS holder 26, the CS 22, and the white reference determining member 25. During a reading operation, the CS holder 26 rotates to a reading position close to a recording section (that is, a recording position) on the platen 3, and an image of the original that passes a shared conveying path is read by the CS 22. On the other hand, during a recording operation, the CS holder 26 rotates apart from the reading position on the platen 3 to a reading standby position, and a recording unit 1 that is freely movable on the platen 3 in the main scanning direction carries out a recording operation on the recording sheet that passes the shared conveying path.

Reference numeral 27 designates an original (document) detecting sensor (DS: document sensor) used for detecting the presence of an original on the original tray 11. During a reading operation, an original or document is detected by the DS 27 and the PES 21 detects whether a conveyed medium (an original or a recording sheet) has passed a predetermined position on the shared conveying path.

Figure 7:
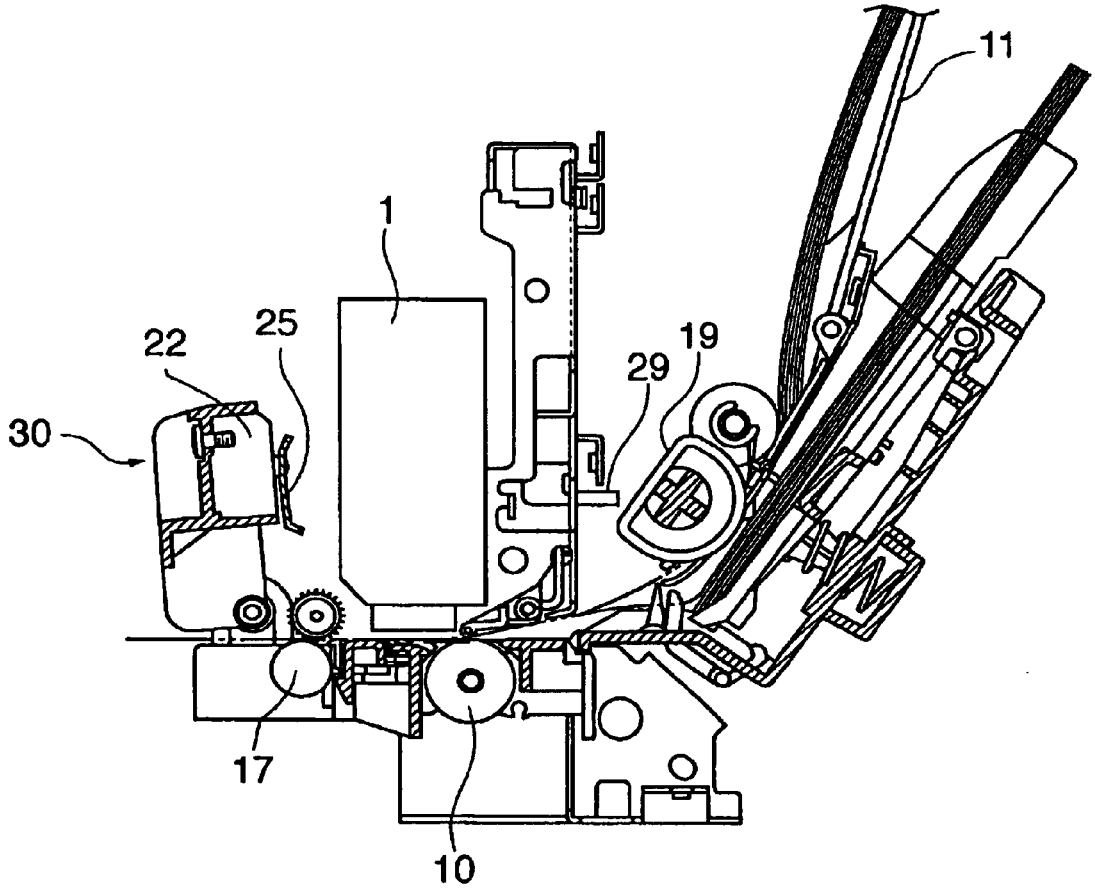
FIG. 7 is a cross-sectional side view showing the internal construction of the multifunction communication apparatus of FIG. 1 in a state where a recording sheet separating/conveying roller shares a space with an original conveying path.

Reference numeral 29 designates a conveying roller monitoring sensor that detects the state of the recording sheet separating/conveying roller (hereinafter referred to as the "recording sheet conveying roller") 19 and is implemented by a transparent type optical sensor. The monitoring sensor 29 detects two states, i.e. a state where light input to conveying roller monitoring sensor 29 is blocked by the recording sheet conveying roller 19 and a state where light is not blocked by the recording sheet conveying roller 19. Here, the state where light input to conveying roller monitoring sensor 29 is blocked by the recording sheet conveying roller 19 refers to an initial state of the recording sheet conveying roller 19. This initial state is a standby state where the recording sheet conveying roller 19 waits when a recording operation is not carried out, and corresponds to a non-sharing state where the recording sheet conveying roller 19 does not share a space with a conveying path for originals (i.e. a state where the recording medium conveying device is in a position for blocking the conveying path for originals, to conveying a recording medium). The non-sharing state is not limited to the initial state. On the other hand, a state where the recording sheet conveying roller 19 shares the space with the conveying path for originals will be referred to as the "sharing state". FIG. 7 is a cross-sectional side view showing the internal construction of the multifunction communication apparatus in the sharing state where the recording sheet conveying roller 19 shares the space with the original conveying path.

The recording unit 1 is provided therein with an ink tank and an ink head (recording head), and records an image based on image information by injecting ink from the ink tank onto a recording sheet 2 through nozzles provided on the ink head. The recording unit 1 is detachably attached to a carriage 4 that is guided by a guide rail 7 that is formed in an inverted U-shape integrally with the top of the chassis 24 and a guide shaft 60 supported by side plates 24*a*, 24*b* at both ends of the chassis 24. The carriage 4 is fixed to a carriage belt 63 and is driven by a carriage motor to move the recording unit 1 in the main scanning direction.

The reading operation and recording operation of the multifunction communication apparatus with the above construction will be described next. First, when an original 12 is set on the original tray 11 during a reading operation, the original 12 is detected by the original detecting sensor (DS) 27 that is located near the original separating/conveying roller (hereinafter referred to as the "original separating roller") 15.

If the user gives an instruction for the start of a reading operation via the operating section 106 in a state where the original 12 has been detected by the original detecting sensor 27, "reading mode" indicative of a reading operation being carried out is stored in a storage section 107 shown in FIG. 7 (described later) as an operation mode, and a reading operation is started. Under the control of a CPU 100 in FIG. 7, the original separating roller 15 is driven to cause one original 12 to be separated by the separating arm 13, and the separated original is fed to the reading position. If on this occasion, the recording sheet conveying roller 19 is in the sharing state shown in FIG. 7 for some reason, the roller 19 protrudes onto the original tray 11 to block the original conveying path. Consequently, the original conveying cannot be carried out accurately and the original being conveyed can be damaged. To avoid this inconvenience, a reading control process, described later, is carried out when the recording sheet conveying roller 19 is in the sharing state, whereby the recording sheet conveying roller 19 is driven or the reading operation is stopped until the recording sheet conveying roller 19 moves to the non-sharing state.

During conveyance of an original, the CS holder 26 is rotated concurrently with the conveyance about the rotary shaft 26*a* towards the platen 3 by the driving force of the feed roller 10, to bring the CS 22 to the reading position. In this state, the feed roller 10 conveys the original 12 on the shared conveying path and the CS 22 reads an image from the original 12 until a trailing edge of the original 12 is detected by the PES 21. The image read by the CS 22 is converted into image information by a predetermined method and the image information is stored in the storage section 107 shown in FIG. 7.

When the reading of the image from the original 12 has been completed, the original 12 is discharged from the apparatus by the discharge roller 17. When the user has given an instruction for a reading operation for a plurality of originals, after the discharging of an original has been completed, the next original 12 is separated and fed and an image of this next original 12 is read in the same way. When the reading of images has been completed for the number of originals 12 indicated by the user, the CS holder 26 is finally rotated to the reading standby position apart from the reading position on the platen 3, and the reading operation is completed.

Next, in a recording operation, when the user gives an instruction for the start of a recording operation using the operating section 106, if the CS holder 26 has been rotated to the reading position, before the recording operation starts, the CS holder 26 is receded from the reading position to the reading standby position. After this, "recording mode" indicative of a recording operation being carried out is stored in the storage section 107 shown in FIG. 7 as the operation mode. Consequently, the ink cartridge (recording unit) 1 can move in the main scanning direction at and in vicinity of the recording section on the platen 3, so that recording can be carried out on the recording sheet 2 that passes on the shared conveying path.

After this, recording sheets 2 are placed on the recording sheet tray 8 and when one recording sheet 2, out of the recording sheets 2 that are pressed by the pressing plate 9, has been separated by the recording sheet separating roller 19 under the control of the CPU 100 shown in FIG. 7, the recording sheet 2 is fed to the recording section (recording position) on the platen 3.

Next, until the trailing edge of the recording sheet 2 conveyed by the feed roller 10 is detected by the PES 21, the recording unit 1 records an image on the recording sheet 2 based on image information stored in the storage section 107 shown in FIG. 7. When the recording of the image has been completed, the recording sheet is discharged from the apparatus by the discharge roller 17. When a recording operation is to be performed for a plurality of recording sheets 2, after the discharging of a recording sheet on which an image has been recorded has been completed, the processes for separating and feeding the next recording sheet 2 on which an image is to be recorded, recording an image, and discharging the recording sheet are repeated for the remaining number of sheets.

Here, when the recording unit 1 is not performing a recording operation, the recording unit 1 stands by at a home position (recording standby position) (a position shown by the arrow A in FIG. 5) and a cap is placed over the recording head of the recording unit 1 to prevent clogging of the recording head caused by drying of the ink. When a recording operation is carried out, the cap is removed, the recording unit 1 is moved to a recovering operation position (a position shown by the arrow B in FIG. 3), and after an initialization operation, such as a recovering operation of the recording head, has been performed, the recording operation starts. Aside from the initialization operation of the recording unit 1 described above, even if no user instruction has been given via the operating section 106, other initialization operations (such as a recovering operation of the ink cartridge 1 and a remaining ink detecting operation) are executed according to predetermined conditions. Also, as for the timing for carrying out a recording operation, the recording unit 1 starts an initialization operation when the PES 21 detects a recording sheet 2.

Figure 8:
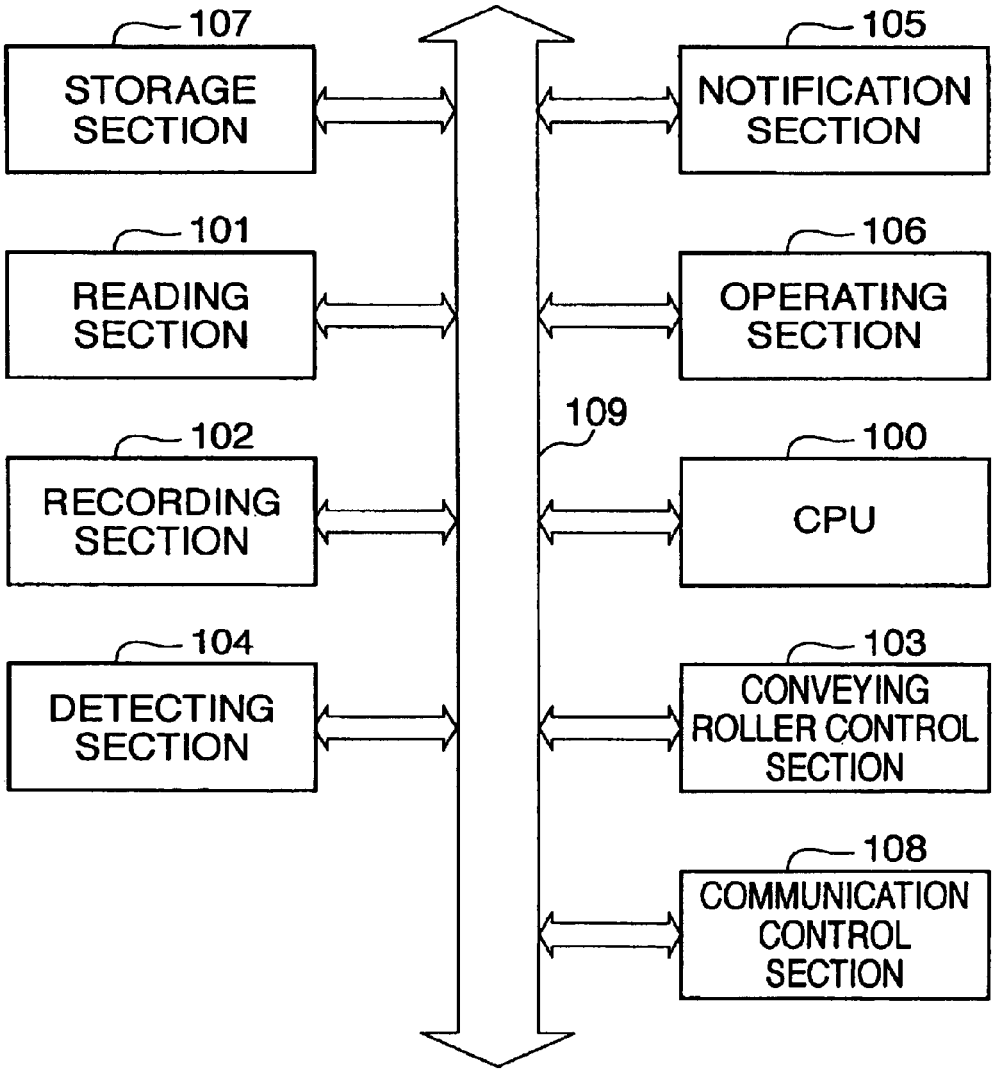
FIG. 8 is a block diagram showing the electrical construction of the multifunction communication apparatus of FIG. 1.

FIG. 8 is a block diagram showing the electrical construction of the multifunction communication apparatus of FIG. 1. This multifunction communication apparatus is comprised of the CPU 100, a reading section 101 including the reading unit 30 that reads an original, a recording section 102 including the recording unit 1 that records an image on a recording sheet based on image information received via facsimile communication and/or image information of an original read by the reading unit 30, a conveying roller control section 103 that controls the original separating roller 15 and the recording sheet conveying roller 19, a detecting section 104 including the PES 21, the DS 27, and the conveying roller state monitoring sensor 29, a notification section 105 implemented by a display device that notifies the user of information on states of the sensors detected by the detecting section 104 and various states of the apparatus, an operating section 106 that is operated by the user to input various information and to give instructions for operations of the apparatus, a communication control section 108 that controls transmission and reception of image information and communication carried out by the handset 121 via a telephone line, and the storage section 107, with these various components being interconnected via a bus 109. An operation mode such as "reading mode" or "recording mode" is stored in the storage section 107, along with various states of the apparatus and image information based on images read by the reading unit 30. A control program, described later, is also stored in a ROM inside the storage section 107.

Figure 9:
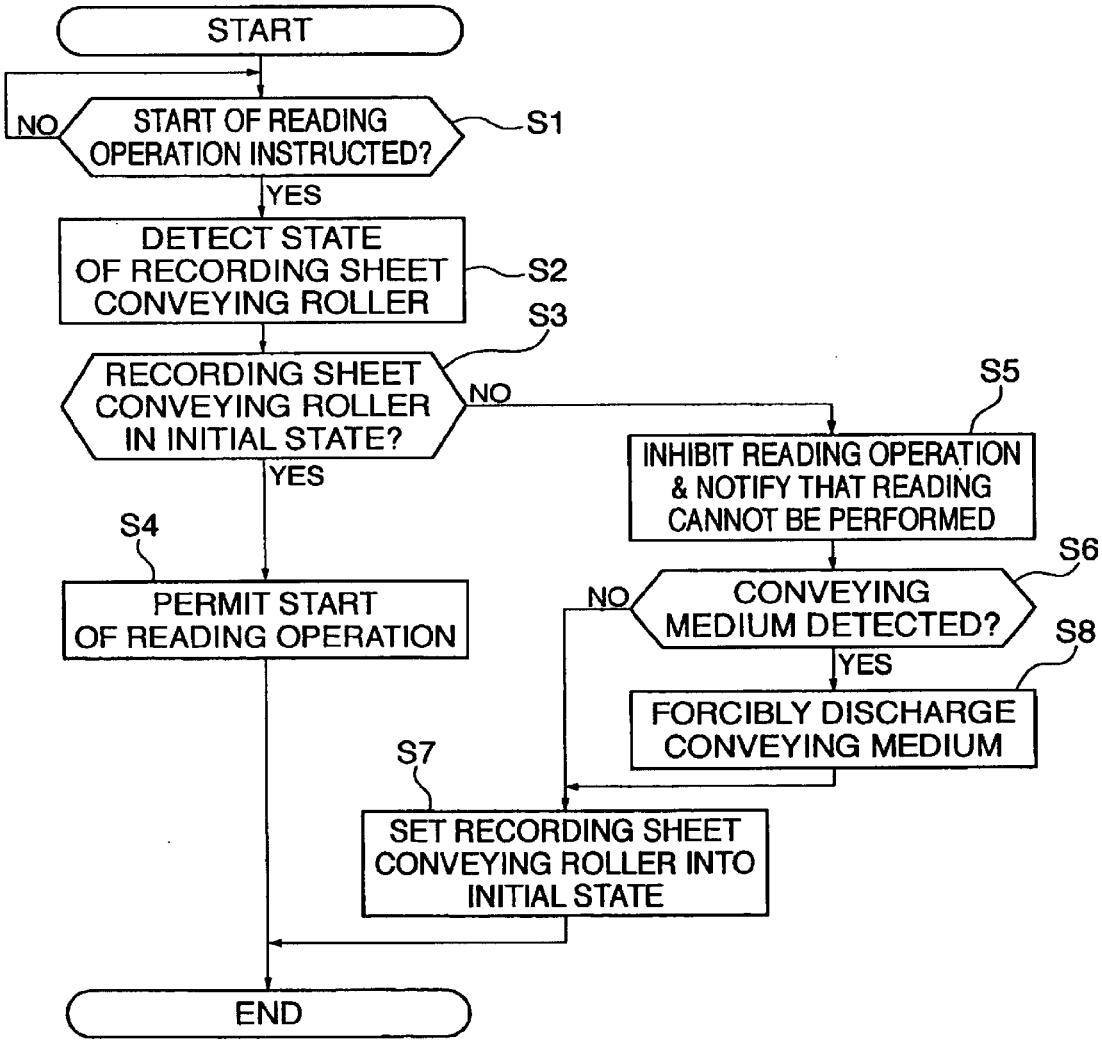
FIG. 9 is a flowchart showing the procedure of an operating process before the start of a reading operation by the multifunction communication apparatus of FIG. 1.

FIG. 9 is a flowchart showing the procedure of an operating process before the start of a reading operation by the multifunction communication apparatus of FIG. 1. A control program for carrying out this process is stored in the ROM inside the storage section 107, described earlier, and is repeatedly executed by the CPU 100 at predetermined time intervals.

First, it is determined whether the user has given an instruction for the start of a reading operation via the operating section 106 (step S1). If no such instruction has been given, the processing in the step S1 is repeated, and if such instruction has been given, the state of the recording sheet conveying roller 19 is detected from the output from the conveying roller state monitoring sensor 29 (step S2). The, it is determined whether the recording sheet conveying roller 19 is in the initial state (step S3). If it is determined that recording sheet conveying roller 19 is in the initial state, this means that a reading operation can be properly carried out, and then the reading operation is permitted to start (step S4), followed by the present process being terminated. This permission causes the reading operation to be started.

On the other hand, if it is determined in the step S3 that the recording sheet conveying roller 19 is not in the initial state, the start of the reading operation is inhibited, that is, separation and conveyance of originals by the original separating roller 15 is inhibited (step S5). At this time, the notification section 105 is caused to display a message to the effect that the recording sheet conveying roller 19 is not in the initial state and that the reading operation cannot be started. Then, it is determined from the output from the PES 21 whether a recording medium (original or recording sheet) remains on the shared conveying path (step S6). If no recording medium remains on the shared conveying path, the recording sheet conveying roller 19 is driven into the initial state (step S7), followed by the present process being terminated. On the other hand, if a recording medium remains on the shared conveying path, the discharge roller 17 is driven to forcibly discharge the recording medium (step S8), and in the step S7 the recording sheet conveying roller 19 is driven into the initial state, and then the present process is terminated. In this way, when the recording sheet conveying roller 19 is not in the initial state, the same roller is returned to the initial state, and then the present process is executed again, whereby the start of the reading operation is permitted in the step S4 and the reading operation (separation and conveyance of originals by the original separating roller 15) is carried out.

Figure 10:
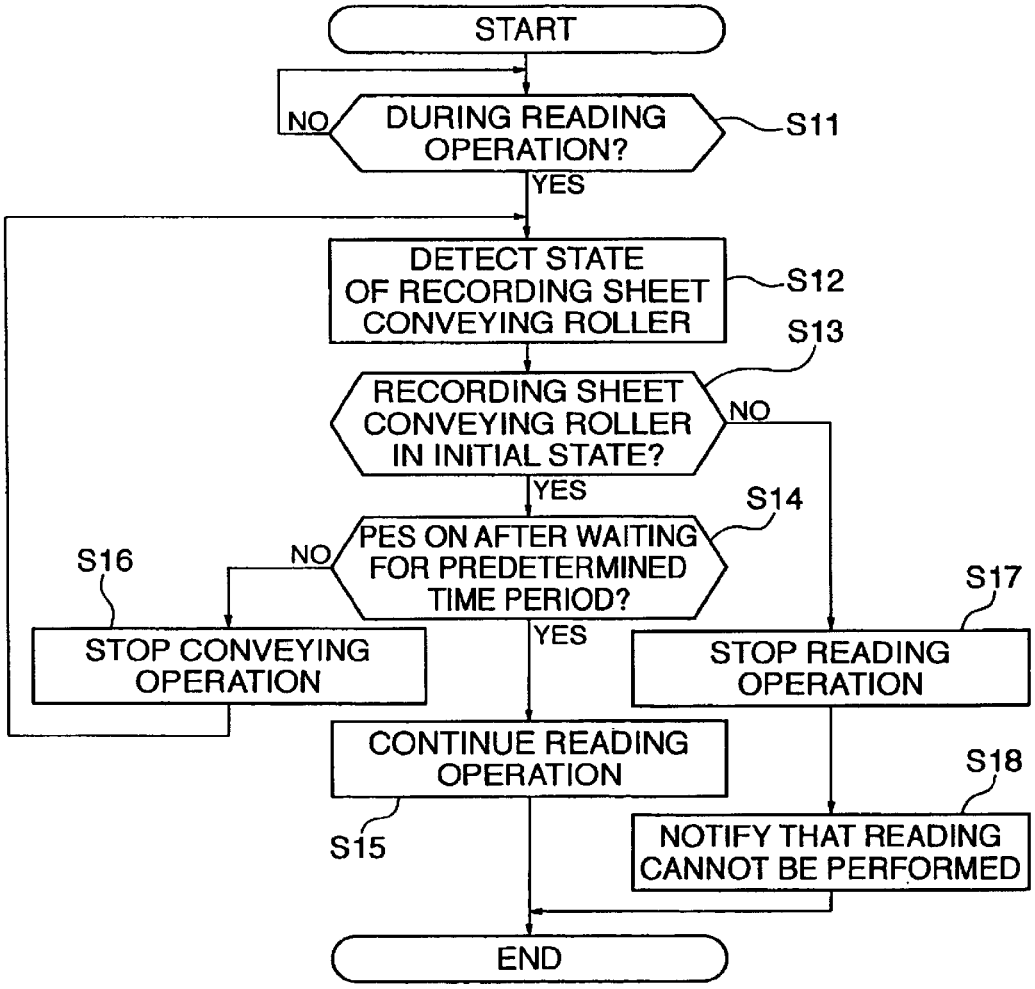
FIG. 10 is a flowchart showing the procedure of an original conveyance monitoring process carried out during original reading by the multifunction communication apparatus of FIG. 1.
Figure 11:
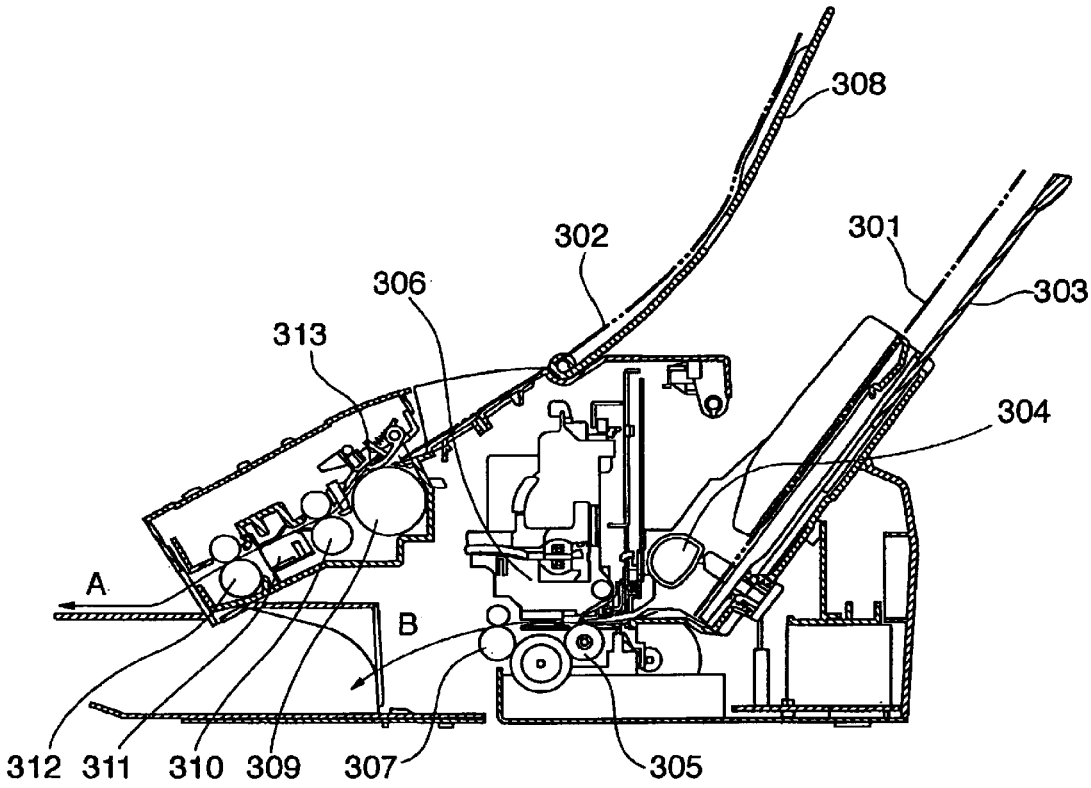
FIG. 11 Prior Art
FIG. 11 is a cross-sectional view showing the construction of a conventional reading/recording apparatus.

FIG. 10 is a flowchart showing the procedure of an original conveyance monitoring process carried out during original reading by the multifunction communication apparatus of FIG. 1. A control program for carrying out this process is stored in the ROM inside the storage section 107, described earlier, and is repeatedly executed by the CPU 100 at predetermined time intervals.

First, the CPU 100 waits until an original reading operation starts (step S11). When the original reading operation starts, the state of the recording sheet conveying roller 19 is detected from the output from the conveying roller state monitoring sensor 29 (step S12).

It is then determined whether the recording sheet conveying roller 19 is in the initial state (step S13). If the recording sheet conveying roller 19 is in the initial state, the CPU 100 waits for a time period (predetermined time period) required to pass before the leading edge of the original is detected by the PES 21 after the reading operation starts, and then it is determined whether the PES 21 has turned on (step S14). If the PES 21 has not turned on, the original conveying operation is stopped (step S16), and the process returns to the step S12, whereas, if the PES 21 has turned on, it is judged that the original conveyance is being properly carried out, and the reading operation is continued (step S15), and then the present process is terminated.

On the other hand, if the recording sheet conveying roller 19 is not in the initial state and is in the shared state due to occurrence of some abnormality, the original reading operation (original separation and conveyance by the original separating roller 15, original reading at the original reading position, original discharge, and so forth) is stopped (step S17), and the notification section 105 is caused to notify the user by displaying a message to the effect that the reading operation cannot be performed because the recording sheet conveying roller 19 is not in the initial state (step S18), followed by the present process being terminated.

As described above, according to the present embodiment, even when there occurs a state where the recording sheet conveying roller 19 shares the same space with the conveying path for originals placed on the original tray 11, originals can be properly fed during original reading operation. Specifically, when the user instructs the start of a reading operation, the recording sheet conveying roller 19 is reset to the initial state, whereby originals can be properly fed during original reading operation. Further, if the recording sheet conveying roller 19 is not in the initial state before the start of a reading operation or during a reading operation, the reading operation is stopped or inhibited, whereby damage to originals can be prevented. Moreover, the user is notified of the stoppage or inhibition, whereby the user can know that the multifunction communication apparatus is in an abnormal state and cannot perform a reading operation.

The present invention is not limited to the above described embodiment and can be applied to any construction that can achieve the functions described in the appended claims or the functions of the construction of the above described embodiment.

For example, although in the above described embodiment, during an original reading operation, the recording sheet conveying roller 19 is reset to the initial state (see FIG. 6), the non-sharing state where the recording sheet conveying roller 19 does not block the path for originals when it is conveying recording sheets is not limited to the initial state as shown in FIG. 6, but may be any state insofar as it is a state where the recording sheet conveying roller 19 does not interfere with the space of the space the conveying path for originals such that the conveying path for originals being conveyed is not blocked off. In this sense, the state may be a state where the recording sheet conveying roller 19 has a stoppage angle slightly different from that in the initial state.

Further, although in the above described embodiment, the recording sheet conveying roller 19 has a non-circular or half-moon shape with a flat side surface as shown in FIGS. 6 and 7 and rotates into the sharing state where it shares the space with the original conveying path or into the non-sharing state where it does not share the space with the original conveying path, the recording sheet conveying roller 19 is not limited to the type that carries out such rotation, but it may a roller with a circular shape that is positioned close to the recording sheet 2 on the recording sheet tray 8 during conveyance of recording sheets and positioned remotely from the same during conveyance of originals.

For example, although the present invention is applied to a multifunction communication apparatus with a facsimile communication function and a copying function in the above embodiment, the present invention is not limited to a facsimile apparatus, a copier, or the like, and can be applied to a variety of appliances that can perform a reading operation for an original and a recording operation.

The present invention may either be applied to a system composed of a plurality of apparatuses or to a single apparatus.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of any of the embodiments described above, and hence the program code and the storage medium in which the program code is stored constitute the present invention.

Examples of the storage medium for supplying the program code include a floppy (registered trademark) disk, a hard disk, an optical disk, a magnetic-optical disk, a CD-ROM, a CD-R, a CD-RW, DVD-ROM, a DVD-RAM, a DVD-RW, a DVD+RW, a magnetic tape, a nonvolatile memory card, and a ROM. Alternatively, the program code may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code. Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

What is claimed is:

1. A reading/recording apparatus comprising:

a shared conveying path having at least part thereof used as both a conveying path for an original and a conveying path for a recording medium;

an original conveying device that conveys the original on said shared conveying path;

a reading device that reads an image of the original at a reading position on said shared conveying path;

a recording device that records the read image on the recording medium at a recording position on said shared conveying path;

a recording medium conveying device that is movable between a sharing state where the recording medium conveying device shares a space with the conveying path for the original and a non-sharing state where the recording medium conveying device does not share the space with the conveying path for the original, and conveys the recording medium on said shared conveying path;

a state detecting device that detects a state of said recording medium conveying device; and a control device that stops conveyance of the original by said original conveying device when said recording medium conveying device is detected to be in the sharing state by said state detecting device during a reading operation on the original by said reading device.

2. A reading/recording apparatus according to claim 1, wherein the non-sharing state is an initial state where said recording medium conveying device is on standby when said recording device does not carry out a recording operation on the recording medium.

3. A reading/recording apparatus according to claim 2, comprising a notification device operable when said recording medium conveying device is detected to be in the sharing state by said state detecting device, to notify that said recording medium conveying device is not in the initial state.

4. A reading/recording apparatus according to claim 1, comprising a notification device operable when said recording medium conveying device is detected to be in the sharing state by said state detecting device, to notify that said original conveying device does not carry out an operation of conveying the original.

5. A reading/recording apparatus according to claim 1, comprising a leading edge detecting device operable when said recording medium conveying device is detected to be in the non-sharing state, to detect a leading edge of the original passing on said shared conveying path, and wherein when the leading edge of the original has not been detected, said state detecting device detects the state of said recording medium conveying device again.

6. A reading/recording apparatus according to claim 5, further comprising a reading control device operable when the leading edge of the original has not been detected, to temporarily stop the reading operation by said reading device.

7. A reading/recording apparatus according to claim 1, wherein said recording medium conveying device has a non-circular roller, and said recording medium conveying device is movable between the sharing state and the non-sharing state through rotation of said non-circular roller.

8. A reading/recording apparatus according to claim 1, comprising a storage device that stores image information based on the image of the original read by said reading device.

9. A reading/recording apparatus according to claim 1, wherein said reading device is movable between the reading position and a reading standby position apart from the reading position, and said recording device shares a moving space on said shared conveying path with said reading device, said recording device being movable between the recording position and the recording standby position apart from the recording position.

10. A reading/recording apparatus comprising:

a shared conveying path having at least part thereof used as both a conveying path for an original and a conveying path for a recording medium;

an original conveying device that conveys the original on said shared conveying path;

a reading device that reads an image of the original at a reading position on said shared conveying path;

a recording device that records the read image on the recording medium at a recording position on said shared conveying path;

a recording medium conveying device that is movable between a sharing state where the recording medium conveying device shares a space with the conveying path for the original and a non-sharing state where the recording medium conveying device does not share the space with the conveying path for the original, and conveys the recording medium on said shared conveying path;

a state detecting device that detects a state of said recording medium conveying device; and a control device that inhibits conveyance of the original by said original conveying device when said recording medium conveying device is detected to be in the sharing state by said state detecting device before start of a reading operation on the original by said reading device.

11. A reading/recording apparatus according to claim 10, wherein the non-sharing state is an initial state where said recording medium conveying device is on standby when said recording device does not carry out a recording operation on the recording medium.

12. A reading/recording apparatus according to claim 11, comprising a notification device operable when said recording medium conveying device is detected to be in the sharing state by said state detecting device, to notify that said recording medium conveying device is not in the initial state.

13. A reading/recording apparatus according to claim 10, comprising a notification device operable when said recording medium conveying device is detected to be in the sharing state by said state detecting device, to notify that said original conveying device does not carry out an operation of conveying the original.

14. A reading/recording apparatus according to claim 10, comprising a reading control device that permits the reading operation to be started when said recording medium conveying device is detected to be in the non-sharing state.

15. A reading/recording apparatus according to claim 10, comprising:

a conveying medium detecting device operable when said recording medium conveying device is detected to be in the sharing state, to detect whether a conveying medium exists on said shared conveying path; and a forcible discharge device operable when the conveying medium is detected to exist on said shared conveying path, to forcibly discharges the conveying medium.

16. A reading/recording apparatus according to claim 15, comprising a reading control device that permits the reading operation to be started when said recording medium conveying device is detected to be in the non-sharing state after the conveying medium has been forcibly discharged by said forcible discharge device.

17. A reading/recording apparatus according to claim 10, wherein said recording medium conveying device has a non-circular roller, and said recording medium conveying device is movable between the sharing state and the non-sharing state through rotation of said non-circular roller.

18. A reading/recording apparatus according to claim 10, comprising a storage device that stores image information based on the image of the original read by said reading device.

19. A reading/recording apparatus according to claim 10, wherein said reading device is movable between the reading position and a reading standby position apart from the reading position, and said recording device shares a moving space on said shared conveying path with said reading device, said recording device being movable between the recording position and the recording standby position apart from the recording position.

20. A reading/recording apparatus comprising:

a shared conveying path having at least part thereof used as both a conveying path for an original and a conveying path for a recording medium;

an original conveying device that conveys the original on said shared conveying path;

a reading device that reads an image of the original at a reading position on said shared conveying path;

a recording device that records the read image on the recording medium at a recording position on said shared conveying path;

a recording medium conveying device that is movable between a sharing state where the recording medium conveying device shares a space with the conveying path for the original and a non-sharing state where the recording medium conveying device does not share the space with the conveying path for the original, and conveys the recording medium on said shared conveying path;

a state detecting device that detects a state of said recording medium conveying device; and a control device that causes said recording medium conveying device to move into the non-sharing state when said recording medium conveying device is detected to be in the sharing state by said state detecting device at a start of a reading operation on the original by said reading device.

21. A reading/recording apparatus according to claim 20, wherein the non-sharing state is an initial state where said recording medium conveying device is on standby when said recording device does not carry out a recording operation on the recording medium.

22. A reading/recording apparatus according to claim 21, comprising a notification device operable when said recording medium conveying device is detected to be in the sharing state by said state detecting device, to notify that said recording medium conveying device is not in the initial state.

23. A reading/recording apparatus according to claim 20, comprising a notification device operable when said recording medium conveying device is detected to be in the sharing state by said state detecting device, to notify that said original conveying device does not carry out an operation of conveying the original.

24. A reading/recording apparatus according to claim 20, wherein said recording medium conveying device has a non-circular roller, and said recording medium conveying device is movable between the sharing state and the non-sharing state through rotation of said non-circular roller.

25. A reading/recording apparatus according to claim 20, comprising a storage device that stores image information based on the image of the original read by said reading device.

26. A reading/recording apparatus according to claim 20, wherein said reading device is movable between the reading position and a reading standby position apart from the reading position, and said recording device shares a moving space on said shared conveying path with said reading device, said recording device being movable between the recording position and the recording standby position apart from the recording position.

27. A reading control method of performing a reading operation of reading an image on an original and a recording operation of recording the read image onto a recording medium on a shared conveying path having at least part thereof used as both a conveying path for the original and a conveying path for the recording medium, comprising:

an original conveying step of conveying the original on said shared conveying path;

a reading step of reading an image of the original at a reading position on said shared conveying path;

a recording step of recording an image on the recording medium at the recording position;

a recording medium conveying step of causing a recording medium conveying device to convey the recording medium on said shared conveying path, said recording medium conveying device being movable between a sharing state where the recording medium conveying device shares a space with the conveying path for the original and a non-sharing state where the recording medium conveying device does not share the space with the conveying path for the original;

a state detecting step of detecting a state of said recording medium conveying device; and a control step of stopping conveyance of the original in said original conveying step when said recording medium conveying device is detected to be in the sharing state in said state detecting step during a reading operation on the original in said reading step.

28. A reading control method of performing a reading operation of reading an image on an original and a recording operation of recording the read image onto a recording medium on a shared conveying path having at least part thereof used as both a conveying path for the original and a conveying path for the recording medium, comprising:

an original conveying step of conveying the original on said shared conveying path;

a reading step of reading an image of the original at a reading position on said shared conveying path;

a recording step of recording an image on the recording medium at the recording position;

a recording medium conveying step of causing a recording medium conveying device to convey the recording medium on said shared conveying path, said recording medium conveying device being movable between a sharing state where the recording medium conveying device shares a space with the conveying path for the original and a non-sharing state where the recording medium conveying device does not share the space with the conveying path for the original;

a state detecting step of detecting a state of said recording medium conveying device; and a control step of inhibiting conveyance of the original in said original conveying step when said recording medium conveying device is detected to be in the sharing state in said state detecting step before a start of a reading operation on the original in said reading step.

29. A reading control method of performing a reading operation of reading an image on an original and a recording operation of recording the read image onto a recording medium on a shared conveying path having at least part thereof used as both a conveying path for the original and a conveying path for the recording medium, comprising:

an original conveying step of conveying the original on said shared conveying path;

a reading step of reading an image of the original at a reading position on said shared conveying path;

a recording step of recording an image on the recording medium at the recording position;

a recording medium conveying step of causing a recording medium conveying device to convey the recording medium on said shared conveying path, said recording medium conveying device being movable between a sharing state where the recording medium conveying device shares a space with the conveying path for the original and a non-sharing state where the recording medium conveying device does not share the space with the conveying path for the original;

a state detecting step of detecting a state of said recording medium conveying device; and a control step of causing said recording medium conveying device to move into the non-sharing state when said recording medium conveying device is detected to be in the sharing state in said state detecting step at a start of a reading operation on the original in said reading step.

30. A program for causing a computer to execute a reading control method according to claim 27.

31. A program for causing a computer to execute a reading control method according to claim 28.

32. A program for causing a computer to execute a reading control method according to claim 29.

* * * * *